US009017013B2

(12) United States Patent
Laurello et al.

(10) Patent No.: US 9,017,013 B2
(45) Date of Patent: Apr. 28, 2015

(54) GAS TURBINE ENGINE WITH IMPROVED COOLING BETWEEN TURBINE ROTOR DISK ELEMENTS

(75) Inventors: Vincent P. Laurello, Hobe Sound, FL (US); Kok-Mun Tham, Orlando, FL (US)

(73) Assignee: Siemens Aktiengesellschaft, München (DE)

( * ) Notice: Subject to any disclaimer, the term of this patent is extended or adjusted under 35 U.S.C. 154(b) by 525 days.

(21) Appl. No.: 13/367,728

(22) Filed: Feb. 7, 2012

(65) Prior Publication Data

US 2013/0202408 A1 Aug. 8, 2013

(51) Int. Cl.

| | |
|---|---|
| ***F01D 5/14*** | (2006.01) |
| ***F04D 31/00*** | (2006.01) |
| ***F01D 25/24*** | (2006.01) |
| ***F01D 5/08*** | (2006.01) |

(52) U.S. Cl.

CPC ..... *F01D 5/087* (2013.01)

(58) Field of Classification Search

CPC ..... F01D 5/08; F01D 5/087; F01D 5/088
USPC ..... 415/115, 173.7, 174.4, 174.5
See application file for complete search history.

(56) References Cited

U.S. PATENT DOCUMENTS

| | | | | |
|---|---|---|---|---|
| 5,217,348 | A * | 6/1993 | Rup et al. | 415/115 |
| 5,352,087 | A * | 10/1994 | Antonellis | 415/115 |
| 6,077,034 | A * | 6/2000 | Tomita et al. | 415/110 |
| 6,099,244 | A | 8/2000 | Tomita et al. | |
| 6,398,485 | B1 * | 6/2002 | Frosini et al. | 415/115 |
| 6,761,529 | B2 | 7/2004 | Soechting et al. | |
| 8,016,553 | B1 | 9/2011 | Liang | |
| 2004/0018082 | A1 * | 1/2004 | Soechting et al. | 415/115 |
| 2007/0098545 | A1 | 5/2007 | Alvanos et al. | |
| 2009/0142189 | A1 * | 6/2009 | Kovac et al. | 415/173.7 |
| 2009/0191050 | A1 | 7/2009 | Nereim et al. | |
| 2009/0223202 | A1 * | 9/2009 | Nanataki et al. | 60/224 |
| 2009/0238683 | A1 | 9/2009 | Alvanos et al. | |
| 2011/0020125 | A1 | 1/2011 | Schlosser et al. | |

* cited by examiner

*Primary Examiner* — Dwayne J White
*Assistant Examiner* — Brian P Wolcott

(57) ABSTRACT

A gas turbine engine is provided comprising a forward rotor disk and blade assembly capable of rotating; an aft rotor disk and blade assembly capable of rotating; and a row of vanes positioned between the forward rotor disk and blade assembly and the aft rotor disk and blade assembly. The vane row and the forward rotor disk and blade assembly may define a forward cavity. The vane row may comprise at least one stator vane comprising: a main body and an inner shroud structure comprising a cover. The cover may include a first inner cavity receiving cooling air. The cover may further include at least one cooling flow passage. Cooling air flowing from the cooling flow passage has a tangential velocity component.

17 Claims, 4 Drawing Sheets

GAS TURBINE ENGINE WITH IMPROVED COOLING BETWEEN TURBINE ROTOR DISK ELEMENTS

FIELD OF THE INVENTION

This invention relates in general to a gas turbine engine and improved structure for directing cooling air between turbine rotor disk elements.

BACKGROUND OF THE INVENTION

In order to cool rotor disks and internal vane structure of a gas turbine engine, cooling air circulated through stator vanes is directed to inter-stage cavities between adjacent rotor disks. However, due to the rotation of the rotor disks during operation of the gas turbine engine, windage occurs in the cavities around the stator vane structure. Windage increases the temperature of the cooling air, which reduces the efficiency of the cooling air flow. Further, as platform seals wear, hot working gas is ingested into the inter-stage cavities where sensitive turbine components may become damaged from exposure to the high temperatures of the hot working gas.

SUMMARY OF THE INVENTION

In accordance with a first aspect of the present invention, a gas turbine engine is provided comprising a forward rotor disk and blade assembly capable of rotating; an aft rotor disk and blade assembly capable of rotating; and a row of vanes positioned between the forward rotor disk and blade assembly and the aft rotor disk and blade assembly. The vane row and the forward rotor disk and blade assembly may define a forward cavity. The vane row may comprise at least one stator vane comprising: a main body having a main body inner passage through which cooling air passes and an inner shroud structure comprising a cover coupled to the vane main body. The cover may include a first inner cavity in fluid communication with the main body inner passage so as to receive cooling air from the main body inner passage. The cover may further include at least one cooling flow passage extending from the first inner cavity to the forward cavity. Preferably, the at least one cooling flow passage is configured such that cooling air flowing from the cooling flow passage has a tangential velocity component in a direction of rotation of the forward rotor disk.

The at least one cooling flow passage may be further configured such that cooling air flowing from the cooling flow passage has an axial velocity component in a direction toward the forward rotor disk and blade assembly.

The at least one cooling flow passage may be further configured such that cooling air flowing from the cooling flow passage has an inward radial velocity component.

The gas turbine engine may further comprise a base coupled to the inner shroud structure cover for defining a second inner cavity located radially inward of the first inner cavity, wherein the base is configured such that the second inner cavity communicates with the forward cavity and is at substantially the same pressure as the forward cavity during at least part of operation of the gas turbine engine.

The forward rotor disk and blade assembly may comprise a first primary disk element, first platform structure, a first inner rim extending axially from the primary disk element to a location radially inward of the at least one stator vane, and a first outer rim extending axially from the first platform structure and located near the inner shroud structure cover.

The at least one cooling flow passage is preferably radially nearer to the outer rim than the inner rim.

The aft rotor disk and blade assembly may comprise a second primary disk element, second platform structure, a second inner rim extending axially from the second primary disk element to a location radially inward of the stator vane, and a second outer rim extending axially from the second platform structure.

A plurality of first labyrinth seal teeth may extend radially from the first inner rim and a plurality of second labyrinth seal teeth may extend radially from the second inner rim.

The base may comprise a U-shaped structure having opposing grooves at a radially outer section of the U-shaped structure for receiving mating attachment members of the inner shroud structure cover and a plurality of honeycomb sealing blocks coupled to a radially inner section of the U-shaped structure for engagement with the first and second labyrinth seal teeth.

In accordance with a second aspect of the present invention, a gas turbine engine is provided comprising a forward rotor disk and blade assembly comprising a primary disk element and a platform structure, an inner rim extending from the primary disk element and an outer rim extending from the platform structure. The inner rim may be located radially inwardly of the outer rim. The gas turbine engine may further comprise an aft rotor disk and blade assembly and a row of vanes positioned between the forward rotor disk and blade assembly and the aft rotor disk and blade assembly. The vane row and the forward rotor disk and blade assembly may define a forward cavity. The vane row may comprise at least one stator vane comprising: a main body; and an inner shroud structure comprising a cover coupled to the main body and including a first inner cavity receiving cooling air. The inner shroud structure cover may further include at least one cooling flow passage extending from the first inner cavity to the forward cavity and may be located nearer to the outer rim than to the inner rim.

The at least one cooling flow passage may be configured such that cooling air flowing from the cooling flow passage has an inward radial velocity component.

The at least one cooling flow passage may be further configured such that cooling air flowing from the cooling flow passage has a tangential velocity component in a direction of rotation of the forward rotor disk.

The at least one cooling flow passage is further configured such that cooling air flowing from the cooling flow passage has an axial velocity component in a direction toward the forward rotor disk.

The gas turbine engine may further comprise a base coupled to the inner shroud structure cover for defining a second inner cavity located radially inward of the first inner cavity. The base may be configured such that the second inner cavity communicates with the forward cavity and is at substantially the same pressure as the forward cavity during at least part of the operation of the gas turbine engine.

The inner rim may extend axially from the primary disk element to a location radially inward of the stator vane, and the outer rim may be located near the inner shroud structure cover.

The at least one cooling flow passage may comprise a plurality of cooling flow passages.

In accordance with a third aspect of the present invention, a gas turbine engine is provided comprising: a forward rotor disk and blade assembly capable of rotating; an aft rotor disk and blade assembly capable of rotating; and a row of vanes positioned between the forward rotor disk and blade assembly and the aft rotor disk and blade assembly. The vane row and the forward rotor disk and blade assembly define a forward cavity. The vane row may comprise at least one stator vane comprising: a main body; and an inner shroud structure comprising a cover coupled to the vane main body. The cover may include a first inner cavity receiving cooling air. The cover may further include at least one cooling flow passage extending from the first inner cavity to the forward cavity, wherein the at least one cooling flow passage is configured such that cooling air flowing from the cooling flow passage has a tangential velocity component in a direction of rotation of the forward rotor disk and blade assembly.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
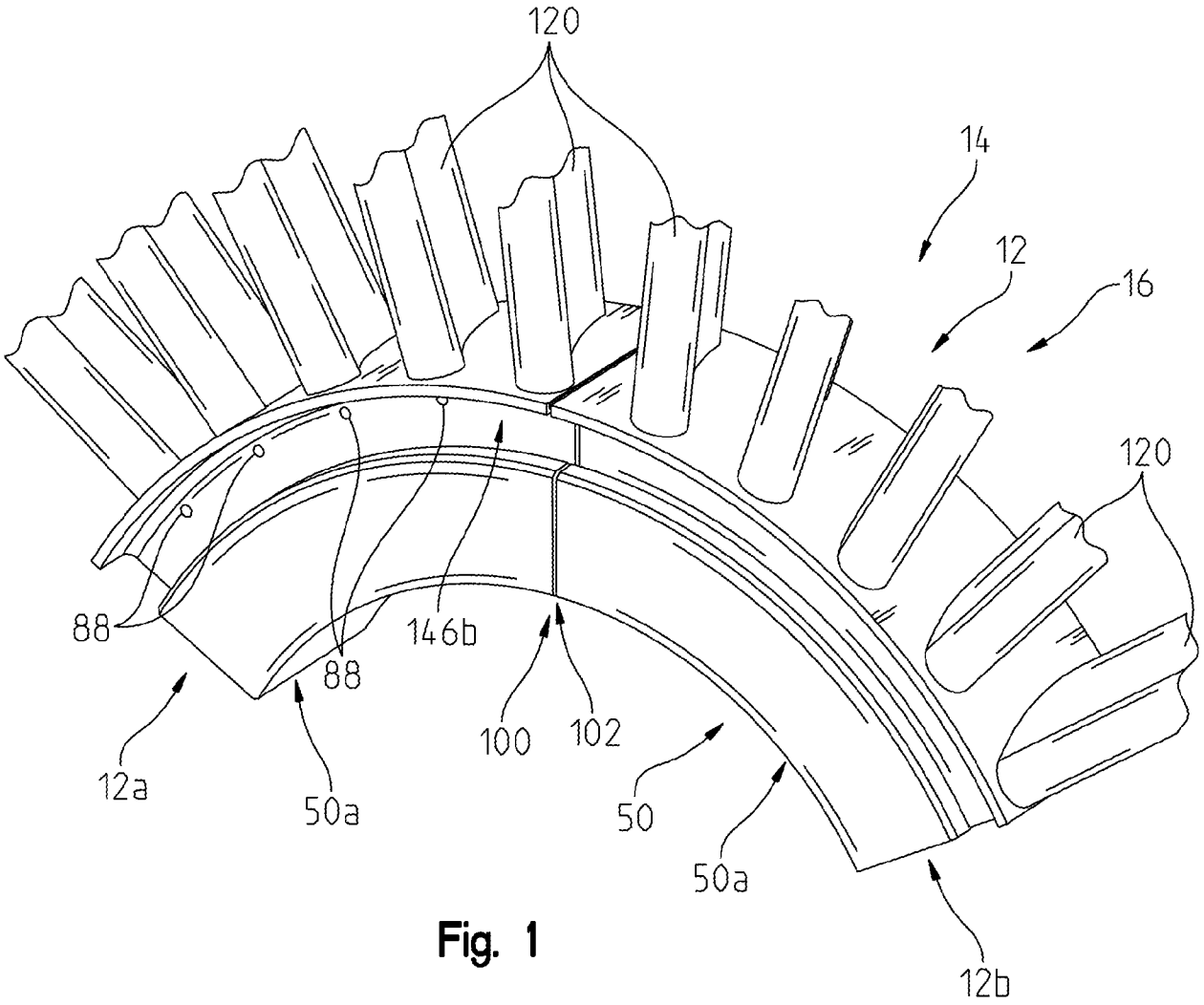
FIG. 1 is a partial perspective view of a vane row of a gas turbine engine according to one aspect of the present invention.

Reference is now made to FIG. 1, which shows a stationary row 12 of stator vanes 120 as part of a turbine 14 of a gas turbine engine 16. Additional rows of vanes (not shown) are also provided within the turbine 14. Corresponding rows of rotating blades are further provided within the turbine 14. Each pair of rows of vanes and blades is called a stage. Typically, there are four stages in a turbine. The rotating blades are coupled to a shaft and rotor disc assembly.

The gas turbine engine 16 further comprises a compressor (not shown) and the turbine 14. The compressor (not shown) generates compressed air, at least a portion of which is delivered to an array of combustors (not shown) arranged axially between the compressor and the turbine 14. The compressed air generated from the compressor is mixed with fuel and ignited in the combustors to provide hot working gases to the turbine 14. As the working gases expand through the turbine 14, the working gases cause the blades, and therefore the shaft and rotor disc assembly, to rotate.

Figure 2:
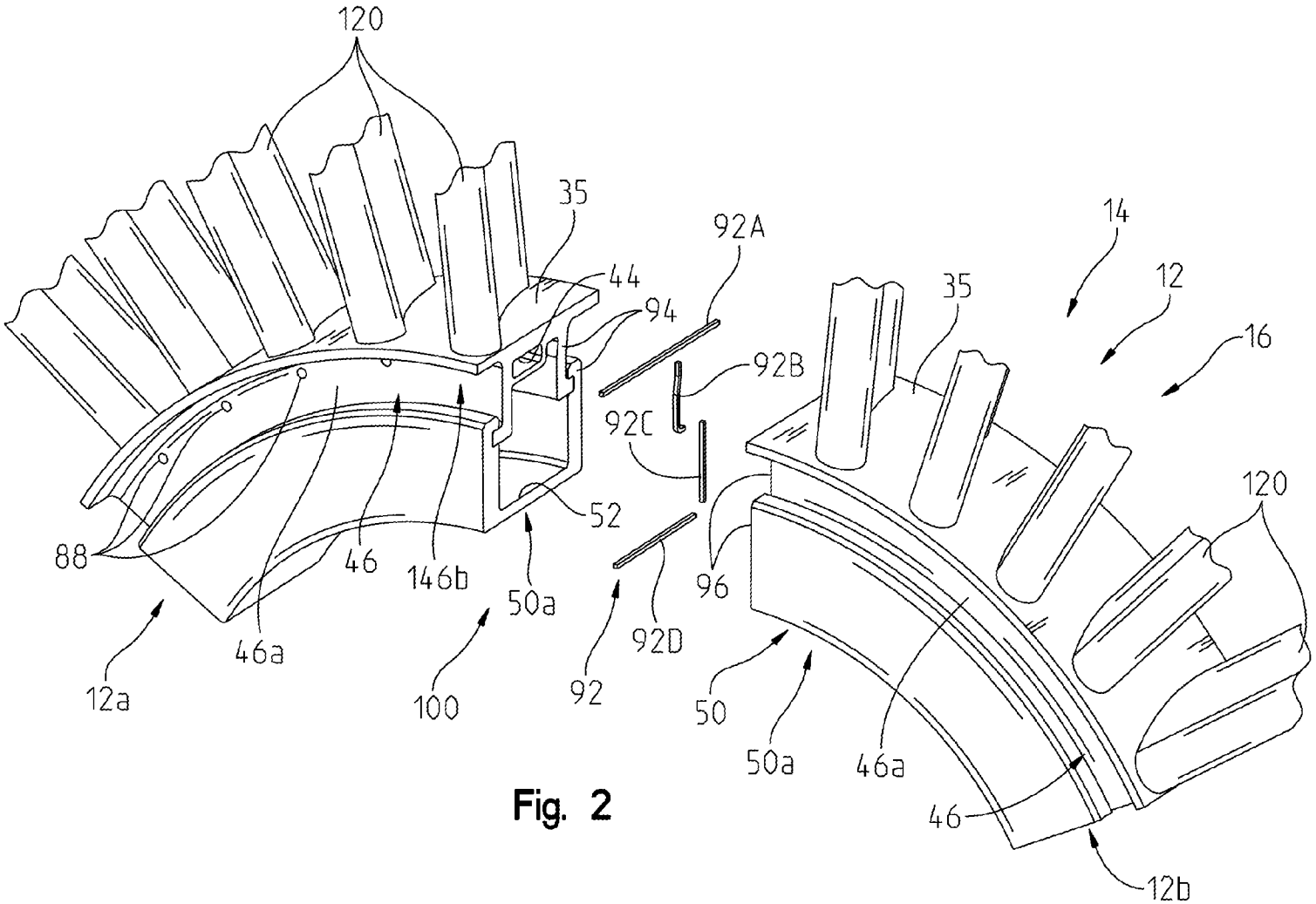
FIG. 2 is an exploded partial view of two vane row segments of the gas turbine engine of the present invention.

Referring now to FIGS. 1 and 2, the vane row 12 in the illustrated embodiment of the present invention comprises a plurality of vane row segments 12*a*, 12*b* that are aligned circumferentially within the turbine 14 to form the vane row 12. A first vane row segment 12*a* and a second vane row segment 12*b* are shown in the illustrated embodiment of FIGS. 1 and 2. While only two vane row segments are illustrated in FIGS. 1 and 2, more than two vane row segments may be provided. The first and second vane row segments 12*a*, 12*b* are sealed via a generally C-shaped sealing structure 92 interposed between the vane row segments 12*a*, 12*b*, as shown in FIG. 2. The sealing structure 92 comprises four sealing members 92A-92D in the illustrated embodiment, which are coupled to the vane row segments 12*a*, 12*b* via slots provided in the vane row segments 12*a*, 12*b*. The sealing structure 92 provides a seal at a vane row segment junction 100 between a first vane row segment end face 94 and a second vane row segment end face 96, see FIG. 2. As shown more clearly in FIG. 5 and discussed further below, the sealing structure 92 in the illustrated embodiment of the present invention seals a portion of a perimeter of the vane row segment junction 100, but does not seal at a forward side 98 of the vane row segment junction 100.

Figure 3:
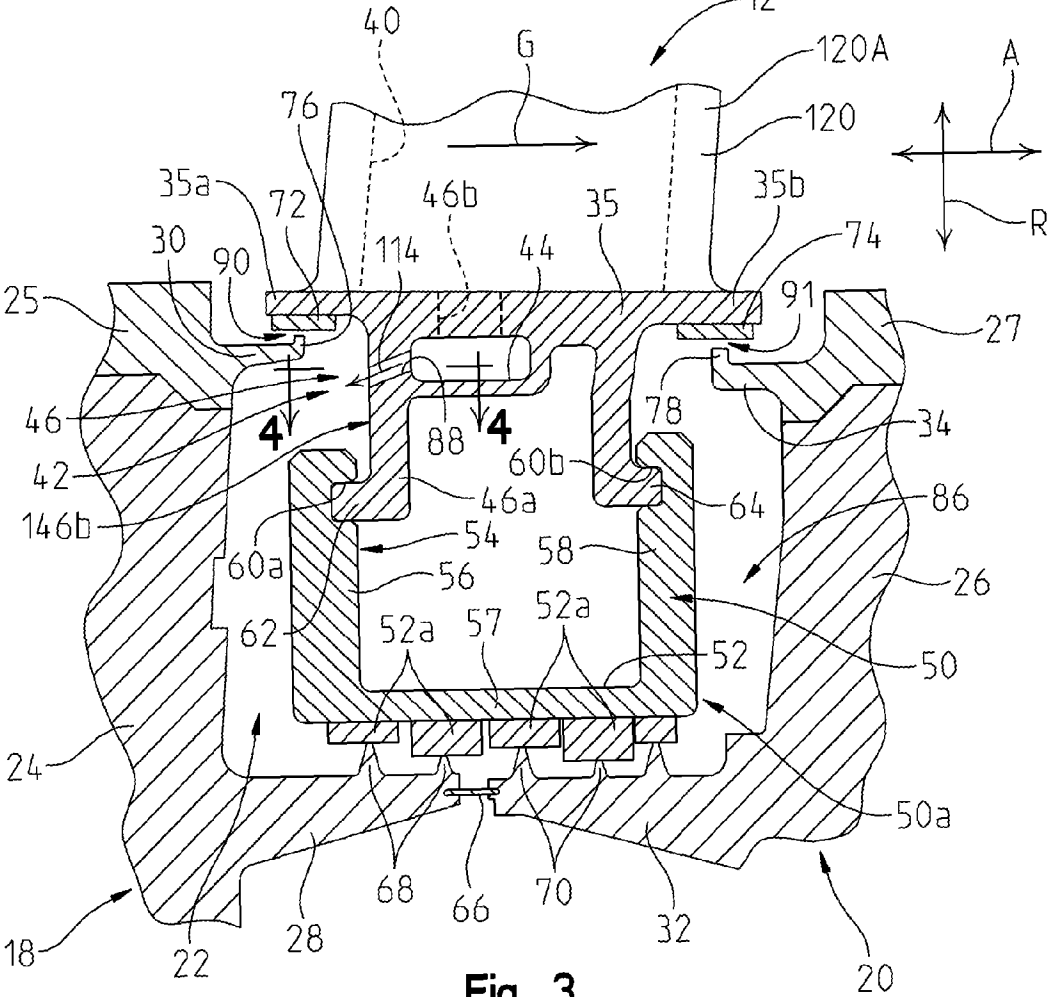
FIG. 3 is an enlarged partial cross-sectional view of the turbine according to the present invention.

As noted above, the turbine 14 comprises a plurality of blades, which are coupled to the shaft and rotor disc assembly. The shaft and rotor disc assembly comprises a plurality of rotor disk elements, each supporting a row of blades and mounted to rotatable shaft (not shown). Referring now to FIG. 3, the row 12 of vanes 120 is shown positioned between a first rotor disk and blade assembly 18 (also referred to herein as a "forward rotor disk and blade assembly") and a second rotor disk and blade assembly 20 (also referred to herein as an "aft rotor disk and blade assembly").

The forward rotor disk and blade assembly 18 comprises a first primary rotor disk element 24 and a first platform structure 25. The first platform structure 25 may comprises a plurality of circumferentially arranged platforms, each forming a bottom portion of one or more corresponding blades of one blade row. The aft rotor disk and blade assembly 20 comprises a second primary rotor disk element 26 and a second platform structure 27. The second platform structure 27 may comprises a plurality of circumferentially arranged platforms, each forming a bottom portion of one or more corresponding blades of another blade row.

Figure 5:
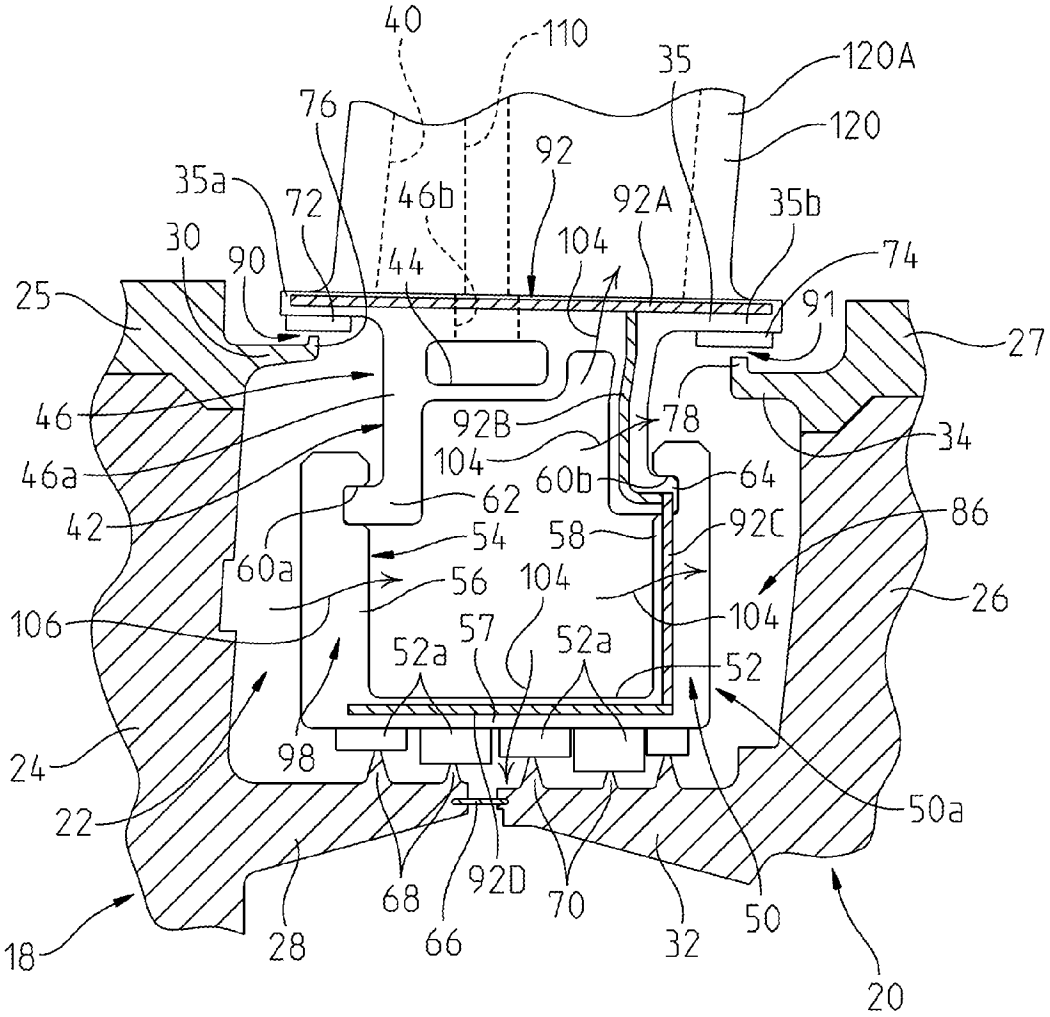
FIG. 5 is an enlarged partial cross-sectional view of the turbine according to the present invention.

A first inner rim 28 extends in an axial direction from the first primary disk element 24, see FIGS. 3 and 5. A first outer rim 30 extends in an axial direction from the first platform structure 25, see FIGS. 3 and 5. The first inner rim 28 is located radially inwardly of the first outer rim 30, as shown in the illustrated embodiment of FIGS. 3 and 5, and extends axially to a location radially inward of the vane row 12. Similarly, a second inner rim 32 extends in an axial direction from the second primary disk element 26, see FIGS. 3 and 5. A second outer rim 34 extends in an axial direction from the second platform structure 27, see FIGS. 3 and 5. The second inner rim 32 is located radially inwardly of the second outer rim 34, also shown in the illustrated embodiment of FIGS. 3 and 5, and extends axially to a location radially inward of the vane row 12. An inter-stage cavity seal 66 joins the first inner rim 28 and the second inner rim 32 at a location radially inward of the vane row 12. A forward cavity 22 is defined by the vane row 12 and the forward rotor disk and blade assembly 18. The vane row 12 and the aft rotor disk and blade assembly 20 define an aft cavity 86.

Referring to FIGS. 1, 2 and 3, the vane row 12 comprises a plurality of circumferentially arranged platforms 35, each integral with and forming a bottom portion of one or more corresponding vanes 120. Each vane 120 also comprises a main body or airfoil 120*a* coupled to its corresponding platform 35. Hot working gases flow around each vane main body 120A. The main body 120*a* of each vane 120 comprises a main body inner passage 40 through which cooling air passes, as illustrated in FIG. 3. The circulation of cooling air prevents damage to the turbine components caused by exposure to the hot working gases.

The vane row 12 further comprises an inner shroud structure 42 coupled to radially inner ends of the vane platforms 35, as shown in FIGS. 1-3 and 5. The inner shroud structure 42 is defined by a cover 46 that is integral with the vane platforms 35 in the illustrated embodiment. The cover 46 may be formed by a plurality of circumferentially arranged cover sections 46*a*, wherein each cover section 46*a* is integral with a corresponding vane platform 35 via casting or welding. The cover 46 includes a circumferentially extending first inner cavity 44 that is in fluid communication with the inner passage 40 of each main body 120A via a corresponding bore 46*b* extending between the main body inner passage 40 and the inner cavity 44. Hence, the first inner cavity 44 receives cooling air from each main body inner passage 40. In an alternative embodiment, the cooling fluid may flow through a transport tube 110, shown in phantom only in FIG. 5, positioned within each inner passage 40, resulting in the cooling air having less heat transferred to it from the corresponding main body 120*a* before it moves through the corresponding bore 46*b* and into the inner passage 40.

The cover 46 further comprises a plurality of circumferentially spaced apart cooling flow passages 88, each extending from the first inner cavity 44, to an outer surface 146*b* of the cover so as to communicate with the forward cavity 22, see FIGS. 1-3 and 5. The cooling flow passages 88 are positioned within the cover 46 such that each cooling flow passage 88 is radially nearer to the first outer rim 30 than the first inner rim 28. Preferably, the cooling flow passages 88 are located radially very close to the first outer rim 30 so as to inject cooling air at a radially outer portion of the forward cavity 22. The cooling flow passages 88 are also formed and positioned within the cover 46 so as to extend from the first inner cavity 44 radially inward in a radial direction R, see FIG. 3, tangentially in a tangential direction T, and axially in an axial direction A, see FIGS. 3 and 4. Preferably, the cooling flow passages 88 extend tangentially in a direction of rotation of the forward and aft rotor disk and blade assemblies 18 and 20, wherein the direction of rotation of the assemblies 18 and 20 is defined by arrow 112 in FIG. 4.

A base 50 is coupled to the inner shroud structure cover 46. The base 50 may comprise a plurality of circumferentially arranged base elements 50*a*. The base defines a circumferentially extending second inner cavity 52 located radially inward of the first inner cavity 44, see FIGS. 2, 3 and 5. The base 50 comprises a U-shaped structure 54 having a forward section 56, an aft section 58 and a middle section 57, see FIGS. 3 and 5. The forward section 56 and aft section 58 of the base 50 have opposing grooves 60*a* and 60*b* for receiving respectively a forward mating attachment member 62 and an aft mating attachment member 64 of the inner shroud structure cover 46. In the illustrated embodiment shown in FIGS. 3 and 5, the grooves 60*a* and 60*b* receive the forward and aft mating attachment members 62, 64 in a friction-fit relationship.

Referring again to FIGS. 3 and 5, a plurality of first labyrinth seal teeth 68 extend radially from the first inner rim 28 and a plurality of second labyrinth seal teeth 70 extend radially from the second inner rim 32. Additionally, a plurality of honeycomb sealing blocks. 52A are coupled to a radially inner side of the middle section 57 of the U-shaped structure 54 of the base 50. The honeycomb sealing blocks 52A in the illustrated embodiment of the present invention comprise an abradable material and cooperate with the first and second labyrinth seal teeth 68, 70 to form a series of knife-edge seals against the flow of cooling air below the base 50 in the axial direction. As shown in FIGS. 3 and 5, the heights of the labyrinth seal teeth 68, 70 and the honeycomb sealing blocks 52A vary such that sealing points are provided at different radial distances relative to the base 50.

At least one forward honeycomb block 72 is coupled to a radially inner side of a forward end 35*a* of each vane platform 35, while at least one aft honeycomb block 74 is coupled to a radially inner side of an aft end 35*b* of each vane platform 35. The forward and aft honeycomb blocks 72, 74 in the illustrated embodiment of the present invention are brazed to the platforms 35. Additionally, the first outer rim 30 comprises a radially extending forward labyrinth seal tooth 76 and the second outer rim 34 comprises a radially extending aft labyrinth seal tooth 78. The forward honeycomb block 72 in the illustrated embodiment of the present invention comprises an abradable material and cooperates with the forward labyrinth seal tooth 76 to form a forward knife-edge seal 90 between the vane platforms 35 and the first platform structure 25. The aft honeycomb block 74 in the illustrated embodiment of the present invention comprises an abradable material and cooperates with the aft labyrinth seal tooth 78 to form an aft knife-edge seal 91 between the vane platforms 35 and the second platform structure 27.

Figure 4:
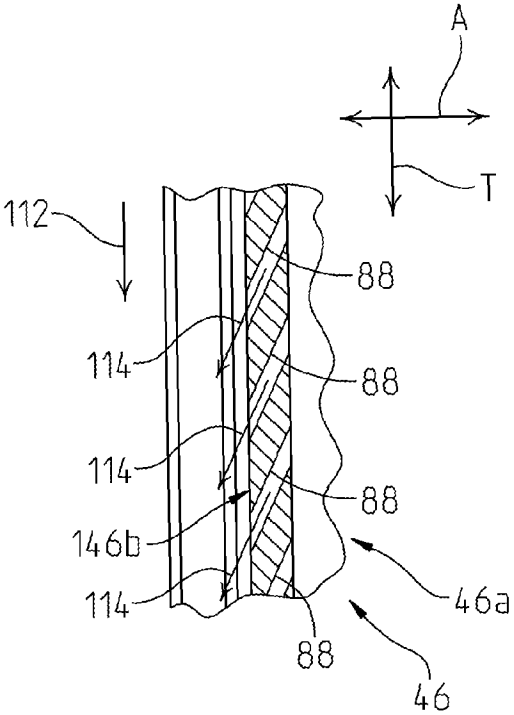
FIG. 4 is an enlarged cross-sectional view taken along section line 4-4 in FIG. 3.

As noted above, cooling air flows from the vane main body inner passages 40, into the first inner cavity 44 and to the forward cavity 22 via the cooling flow passages 88. Due to the configuration of the flow passages 88, the cooling air flowing out of the passages 88, designated by arrows 114 in FIGS. 3 and 4, has an axial velocity component in the axial direction A toward the forward rotor disk and blade assembly 18 and an inward radial velocity component in the radial direction R away from a path G of the hot working gases, see FIG. 3, such that cooling air impinges on and cools the first primary disk element 24 and the first platform structure 25. The cooling air flowing out of the passages 88 also has a tangential velocity component in the direction of rotation 112 of the forward rotor disk and blade assembly 18, as illustrated in FIG. 4, such that the cooling air is moving in generally the same circumferential or tangential direction as the forward rotor disk and blade assembly 18 as it exits the passages 88. This reduces the amount of aerodynamic resistance caused by the cooling air exiting the passages 88 on the forward rotor disk and blade assembly 18 and, in turn, reduces the amount of pump work that the forward rotor disk and blade assembly 18 must perform on the air to cause the air to move circumferentially at generally the same circumferential speed as the forward rotor disk and blade assembly 18, thereby making operation of the turbine more efficient. Further, because less work must be done by the forward rotor disk and blade assembly 18 to the cooling air in the forward cavity 22, windage losses, i.e., fluid friction losses, are reduced; hence, the temperature of the cooling air within the forward cavity 22 remains lower, further increasing the efficiency of the turbine by minimizing the amount of cooling air to achieve a certain level of cavity temperature.

It is also noted that some level of hot working gas ingestion into the forward cavity 22 may occur, particularly as the knife-edge seal 90 deteriorates. As noted above, the cooling flow passages 88 are located radially very near to the first outer rim 30 such that cooling air is introduced into a radially outer portion of the forward cavity 22. Hence, any hot working gases that move into the forward cavity 22 through the knife-edge seal 90 are cooled by the cooling air, thereby minimizing or preventing any damage to the first primary rotor disk element 24 or the base 50 of the vane row 12.

Referring again to the illustrated embodiment shown in FIGS. 2 and 5, the sealing structure 92 does not seal between the first vane row segment end face 94 and the second vane row segment end face 96 at a forward side 98 of the vane row segment junction 100. As a result, cooling air is permitted to flow from the forward cavity 22 into the second inner cavity 52 through a gap 102 formed at the forward side 98 of the vane row segment junction 100, as illustrated by arrow 106 in FIG. 5. As noted above, more than two vane row segments may be provided, and a gap 102 through which cooling air flows may be provided at each of a plurality of circumferentially spaced vane row segment junctions 100 in the vane row 12.

The first inner cavity 44 is sealed, except for communication with the bores 46*b* and passages 88, to prevent cooling air leakage from the cavity 44. Hence, the pressure of the cooling air within the inner cavity 44 is higher there as compared to the pressure of the cooling air in the forward cavity 22, where the pressure is slightly lower. The flow of cooling air through the one or more gaps 102 at the vane row segment junction(s) 100 allows the second inner cavity 52 within the base 50 to be at substantially the same pressure as the forward cavity 22 during at least part of the operation of the gas turbine engine 16. Meanwhile, some leakage of cooling air is permitted past the sealing structure 92 in a radially outward, radially inward, and an axially aft direction, as shown by the arrows 104 in FIG. 5. The pressure within the aft cavity 86 is lower than the pressure in the forward cavity 22 and the second inner cavity 52 due to the sealing structure 92 between the second inner cavity 52 and the aft cavity 86. Utilizing the sealed first inner cavity 44, which forces cooling air into the forward cavity 22 before it flows downstream into the second inner cavity 52, ensures a sufficient supply of cooling air for all turbine rotor disk structures sensitive to the hot working gas temperatures.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine comprising:

a forward rotor disk and blade assembly capable of rotating;

an aft rotor disk and blade assembly capable of rotating; and a row of vanes positioned between said forward rotor disk and blade assembly and said aft rotor disk and blade assembly;

said vane row and said forward rotor disk and blade assembly defining a forward cavity;

said vane row comprising at least one vane row segment; the at least one vane row segment comprising:

a plurality of stator vanes each comprising a main body having a main body inner passage through which cooling air passes; and an inner shroud structure comprising a cover including a first inner cavity extending circumferentially between said vanes and in fluid communication with said main body inner passage of each of said vanes so as to receive cooling air from said vane main body inner passages, said cover further including a plurality of cooling flow passages extending from said first inner cavity to said forward cavity, wherein said cooling flow passages are configured such that cooling air flowing from said cooling flow passages has a tangential velocity component in a direction of rotation of said forward rotor disk and blade assembly.

2. The gas turbine engine as set forth in claim 1, wherein said cooling flow passages are further configured such that cooling air flowing from said cooling flow passages has an axial velocity component in a direction toward said forward rotor disk and blade assembly.

3. The gas turbine engine as set forth in claim 2, wherein said cooling flow passages are further configured such that cooling air flowing from said cooling flow passages has an inward radial velocity component.

4. The gas turbine engine as set forth in claim 1, further comprising a base coupled to said inner shroud structure cover for defining a second inner cavity located radially inward of said first inner cavity, wherein said base is configured such that said second inner cavity communicates with said forward cavity.

5. The gas turbine engine as set forth in claim 1, wherein said forward rotor disk and blade assembly comprises:

a first primary disk element;

a first platform structure;

a first inner rim extending axially from said primary disk element to a location radially inward of said at least one stator vane; and a first outer rim extending axially from said first platform structure and located near said inner shroud structure cover, wherein said at least one cooling flow passage is radially nearer to said outer rim than said inner rim.

6. The gas turbine engine as set forth in claim 5, wherein said aft rotor disk and blade assembly comprises:

a second primary disk element;

a second platform structure;

a second inner rim extending axially from said second primary disk element to a location radially inward of said stator vane; and a second outer rim extending axially from said second platform structure.

7. The gas turbine engine as set forth in claim 6, wherein a plurality of first labyrinth seal teeth extend radially from said first inner rim and a plurality of second labyrinth seal teeth extend radially from said second inner rim.

8. The gas turbine engine as set forth in claim 7, wherein said base comprises a U-shaped structure having opposing grooves at a radially outer section of said U-shaped structure for receiving mating attachment members of said inner shroud structure cover and a plurality of honeycomb sealing blocks coupled to a radially inner section of said U-shaped structure for engagement with said first and second labyrinth seal teeth.

9. A gas turbine engine comprising:

a forward rotor disk and blade assembly comprising a primary disk element and a platform structure, an inner rim extending from said primary disk element and an outer rim extending from said platform structure, said inner rim being located radially inwardly of said outer rim;

an aft rotor disk and blade assembly; and a row of vanes positioned between said forward rotor disk and blade assembly and said aft rotor disk and blade assembly;

said vane row and said forward rotor disk and blade assembly defining a forward cavity;

said vane row comprising first and second vane row segments each comprising:

at least one stator vane comprising a main body; and an inner shroud structure comprising a cover coupled to said main body and including a first inner cavity receiving cooling air, said inner shroud structure cover further including at least one cooling flow passage extending from said first inner cavity to said forward cavity and being located nearer to said outer rim than to said inner rim; and a generally C-shaped sealing structure interposed between said first and second vane row segments so as seal a perimeter of a junction between said first and second vane row segments but does not seal at a forward side of said junction.

10. The gas turbine engine as set forth in claim 9, wherein said at least one cooling flow passage is configured such that cooling air flowing from said cooling flow passage has an inward radial velocity component.

11. The gas turbine engine as set forth in claim 10, wherein said at least one cooling flow passage is further configured such that cooling air flowing from said cooling flow passage has a tangential velocity component in a direction of rotation of said forward rotor disk and blade assembly.

12. The gas turbine engine as set forth in claim 11, wherein said at least one cooling flow passage is further configured such that cooling air flowing from said cooling flow passage has an axial velocity component in a direction toward said forward rotor disk and blade assembly.

13. The gas turbine engine as set forth in claim 9, further comprising a base coupled to said inner shroud structure cover for defining a second inner cavity located radially inward of said first inner cavity, wherein said base is configured such that said second inner cavity communicates with said forward cavity.

14. The gas turbine engine as set forth in claim 9, wherein said inner rim extends axially from said primary disk element to a location radially inward of said stator vane, and said outer rim is located near said inner shroud structure cover.

15. The gas turbine engine as set forth in claim 9, wherein said at least one cooling flow passage comprises a plurality of cooling flow passages.

16. A gas turbine engine comprising:

a forward rotor disk and blade assembly capable of rotating;

an aft rotor disk and blade assembly capable of rotating; and a row of vanes positioned between said forward rotor disk and blade assembly and said aft rotor disk and blade assembly;

said vane row and said forward rotor disk and blade assembly defining a forward cavity;

said vane row comprising at least one vane row segment comprising:

at least one stator vane comprising a main body having an inner passage and a transport tube provided in said inner passage; and an inner shroud structure comprising a cover coupled to said vane main body, said cover including a first inner cavity extending circumferentially and receiving cooling air flowing through said transport tube, said cover further including a plurality of cooling flow passages extending from said first inner cavity to said forward cavity, wherein said at least one cooling flow passage is configured such that cooling air flowing from said cooling flow passage has a tangential velocity component in a direction of rotation of said forward rotor disk and blade assembly.

17. The gas turbine engine as set forth in claim 1, wherein at least one of said vanes comprises a main body having an inner passage and a transport tube provided in said inner passage.

* * * * *